US007866675B2

(12) United States Patent
Hauser

(10) Patent No.: US 7,866,675 B2
(45) Date of Patent: Jan. 11, 2011

(54) COMPOSITE ICE BLADE

(76) Inventor: Ray L. Hauser, 5758 Rustic Knolls Dr., Boulder, CO (US) 80301

( * ) Notice: Subject to any disclaimer, the term of this patent is extended or adjusted under 35 U.S.C. 154(b) by 0 days.

(21) Appl. No.: 12/754,589

(22) Filed: Apr. 5, 2010

(65) Prior Publication Data

US 2010/0194062 A1 Aug. 5, 2010

(51) Int. Cl.
*A63C 1/34* (2006.01)

(52) U.S. Cl. ..... 280/11.18; 280/11.12

(58) Field of Classification Search ..... 280/11.12, 280/11.18, 28

See application file for complete search history.

(56) References Cited

U.S. PATENT DOCUMENTS

| | | | | | |
|---|---|---|---|---|---|
| 2,150,964 | A * | 3/1939 | Dornseif | 280/11.18 |
| 2,988,369 | A * | 6/1961 | Rebicek | 280/11.12 |
| 3,545,778 | A * | 12/1970 | Weidenbacker | 280/11.12 |
| 4,314,708 | A * | 2/1982 | Zuuring | 280/11.18 |
| 4,907,813 | A * | 3/1990 | Hall | 280/11.18 |
| 5,248,156 | A * | 9/1993 | Cann et al. | 280/11.18 |
| 5,332,242 | A * | 7/1994 | Cann et al. | 280/11.18 |
| 5,743,564 | A * | 4/1998 | Aarnio et al. | 280/811 |
| 5,769,434 | A | 6/1998 | Wurthner | |
| 6,318,738 | B1 * | 11/2001 | Abkowitz et al. | 280/11.18 |
| 6,523,835 | B1 * | 2/2003 | Lyden | 280/11.12 |
| 6,620,523 | B2 * | 9/2003 | Abkowitz et al. | 428/627 |
| 6,669,209 | B2 | 12/2003 | Furzer et al. | |
| 6,761,363 | B2 * | 7/2004 | Fask et al. | 280/11.18 |
| 7,387,302 | B2 * | 6/2008 | Goldsmith et al. | 280/11.12 |
| 7,543,826 | B2 | 6/2009 | Labonte et al. | |
| 7,673,884 | B2 * | 3/2010 | Wuerthner | 280/11.18 |
| 2010/0176564 | A1 * | 7/2010 | Koyess et al. | 280/11.12 |
| 2010/0194062 | A1 * | 8/2010 | Hauser | 280/11.18 |
| 2010/0201088 | A1 * | 8/2010 | Newman et al. | 280/11.18 |

* cited by examiner

*Primary Examiner*—Jeffrey J Restifo
(74) *Attorney, Agent, or Firm*—Krajec Patent Offices, LLC; Russell S. Krajec

(57) ABSTRACT

A composite ice blade may have a metal ice edge bonded to a metal foil. The metal foil may be bonded to a plastic core to form a composite sandwich having a center plastic core and metal sides. The ice edge may be bonded to the foil by welding or brazing, then formed into shape to accept the plastic core. The plastic core may be injection molded directly into the formed metal structure, or bonded to the metal components in a secondary operation.

5 Claims, 12 Drawing Sheets

COMPOSITE ICE BLADE

BACKGROUND

Conventional metal ice skating blades are tough and durable, but are heavy. The weight of the skate blade affects an athlete's performance. Many steel ice skating blades, particularly for hockey skates, are held to a shoe or boot by a blade holder, which is conventionally manufactured from a durable plastic. The skate blades may be replaceable by a fastening mechanism that may be accessed through the boot or through some other assembly mechanism.

SUMMARY

A composite ice blade may have a metal ice edge bonded to a metal foil. The metal foil may be bonded to a plastic core to form a composite sandwich having a center plastic core and metal sides. The ice edge may be bonded to the foil by welding or brazing, then formed into shape to accept the plastic core. The plastic core may be injection molded directly into the formed metal structure, or bonded to the metal components in a secondary operation.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

A composite ice blade may be formed from a metal ice edge that is bonded to a metal foil and joined to a plastic core, resulting in a composite blade that may have lower weight than conventional steel blades.

In one embodiment, a composite blade may be made as a replacement to conventional steel ice hockey skates. In such an embodiment, the composite ice skating blade may have the same shape and size as a conventional ice hockey skate blade, but may have much less weight than an all-steel blade. Such a composite blade may also be used for figure skating.

In another embodiment, a composite blade may be used as a runner for bobsleds, luge sleds, skeleton sleds, cresta sleds, or other runner-type sleds. Throughout this specification, the example of hockey skate blades may be used, but those skilled in the art may appreciate that the same manufacturing concepts, designs, and material selections may apply to other runner-type sleds and other configurations.

The composite blade may be manufactured by joining a metal foil to a metal ice edge, both of which may be steel or other metal parts. The bonded parts may be formed into the shape of the blade to create a formed assembly. The formed assembly may be heat treated prior to joining to the plastic core.

The plastic core may be injection molded into the formed assembly, or may be separately fabricated and joined to the formed assembly using adhesive, which may or may not be reinforced.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

Figure 1:
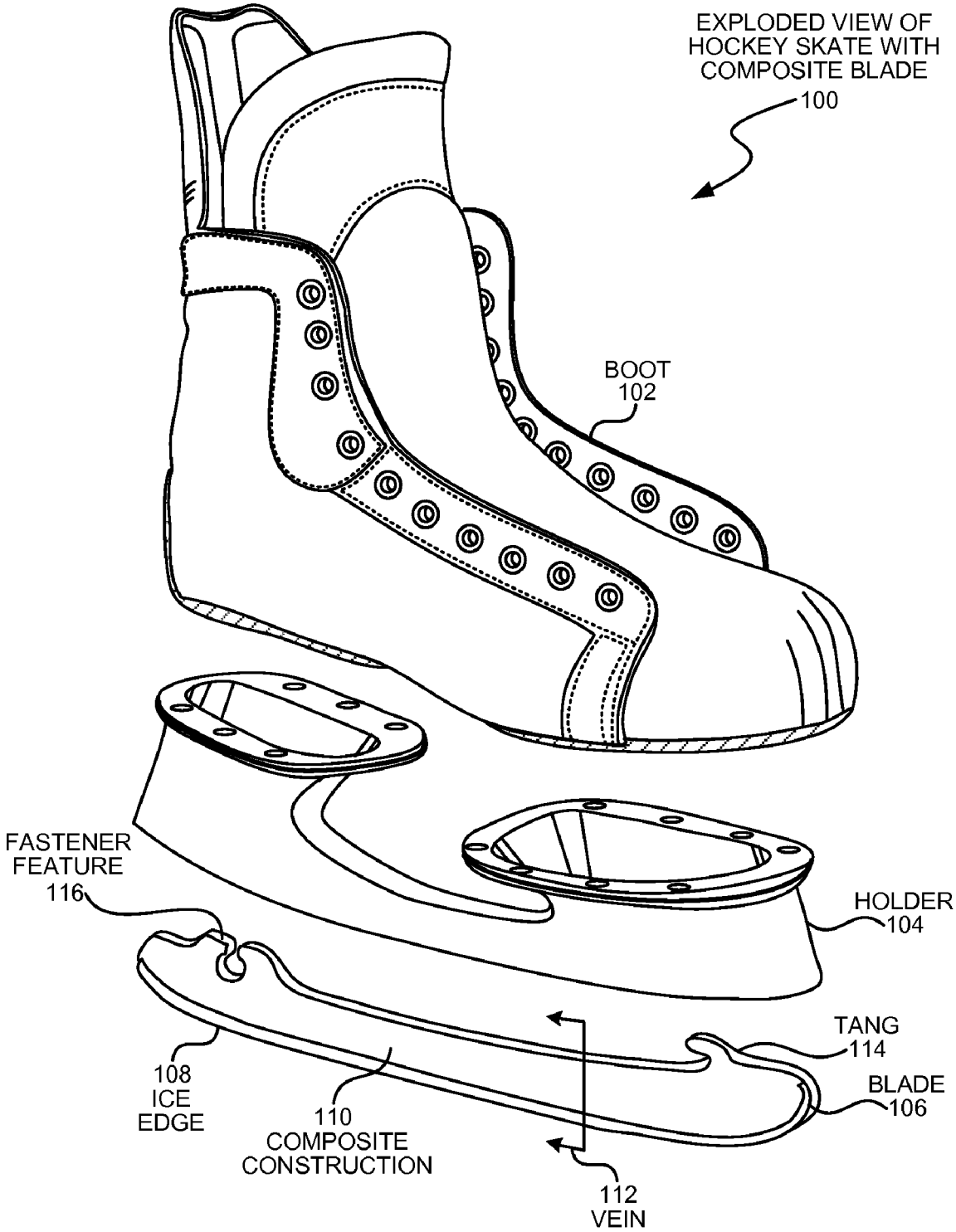
FIG. 1 is a diagram illustration of an embodiment showing an exploded view of a hockey skate with a composite blade.

FIG. 1 is a diagram of an embodiment 100, showing an exploded view of a hockey skate. Embodiment 100 may represent a conventional hockey skate that has a boot 102, a plastic blade holder 104, and a blade 106. The blade 106 may be of composite construction, with a steel or other metal ice edge 108, and a sandwich construction with steel or metal sides and a plastic core.

The boot 102 may be a conventional hockey skate boot. In some embodiments, a boot 102 may be constructed of leather, plastic, composite construction, or any material from which a boot may be constructed.

The holder 104 may be injection molded plastic and may be attached to the boot 102 through a set of rivet holes in the holder 104.

The blade 106 may be attached to the holder 104 by engaging the tang 114 in a corresponding feature in the holder 104, and engaging a fastener through the fastener feature 116. Such a fastener may be accessed through a hole in the heel of the boot 102, and may allow the blade 106 to be removed and replaced without having to remove the holder 104.

The blade 106 may have a steel ice edge 108 and a composite construction 110. The composite construction 110 may have a plastic core to which may be bonded a metal foil component. A cross section at view 112 may be found in embodiment 200 and explained in more detail.

The blade 106 may be straight or have a large radius in the toe-to-heel axis, but may be curved in a perpendicular axis. In many cases, hockey skates, figure skates, and other blades may have a large radius of 100 inches or more through the center portion of the blade, with a tighter radius at the heel and toe ends of the blade.

Figure 2:
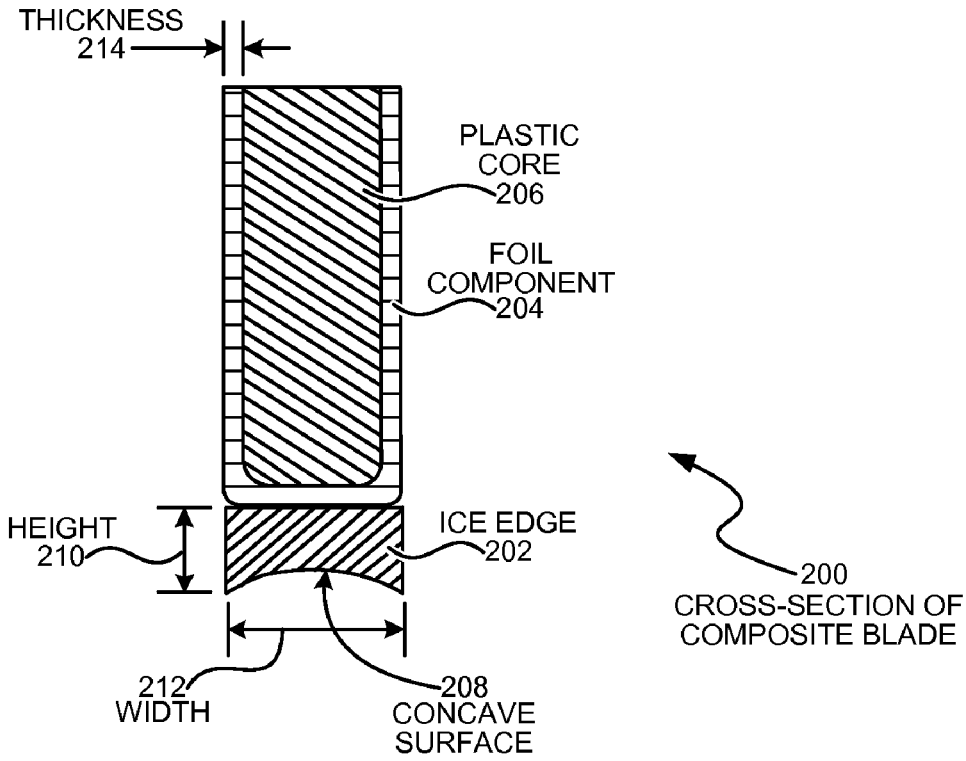
FIG. 2 is a diagram illustration of an embodiment showing a cross-section view of a simplified composite blade.

FIG. 2 is a diagram illustration of an embodiment 200 showing a schematic cross-section of the blade 106 of embodiment 100. FIG. 2 is illustrated as a schematic diagram and is not to scale.

Embodiment 200 illustrates a schematic cross-section of an embodiment showing an ice edge 202, a foil component 204, and a plastic core 206. The various components may be bonded together to create a composite blade that has a metal portion that contacts the ice, metal force transfer surfaces on or near the exterior of the blade, and a plastic core.

The composite blade of embodiment 200 may be manufactured using several different processes. In one process, the metal components of the ice edge 202 and foil components 204 may be joined by brazing or welding, then formed and heat treated. The plastic core may be injection molded directly into the cavity formed by the foil component.

In another process, the formed and joined metal components may be adhesively bonded to a pre-formed plastic core. Details and options for various manufacturing processes may be discussed in more detail later in this specification.

The composite blade of embodiment 200 may have a metal ice edge 202 that may be ground to a conventional concave surface 208. In some embodiments, the ice edge 202 may have a height 210 that may allow for the blade to be re-sharpened once, twice, or several times using conventional skate sharpening systems.

Such embodiments may be constructed with a steel ice edge that may be sharpened using conventional sharpening systems. Examples of such steels may be 400-series or 500-series stainless steel that may be hardened to a Rockwell hardness in the range of C54 to C60. Such embodiments may have a width 212 of 0.115 in and a height 214 of 0.030 in. In embodiments that are designed for re-sharpening, the height 214 may be 0.100 in, 0.150 in, 0.200 in, or greater.

In some embodiments, the blade of embodiment 200 may be disposable and intended for use without sharpening. In such embodiments, the material used for the ice edge 202 may be a higher Rockwell hardness or have other characteristics that may make re-sharpening more difficult using conventional skate re-sharpening machines. Such embodiments may have an ice edge 202 with a height of 0.030 in or less.

The ice edge 202 may be bonded to the foil component 204 using any type of bonding method. In some cases, such a bond may be created using welding, brazing, or other metal-to-metal bonding mechanism. The ice edge 202 and foil component 204 may be bonded together prior to heat treatment.

The foil component 204 may be a steel or other metal with a thickness of 0.003 in to 0.010 in. Some embodiments may have a thickness of 0.005 in, 0.007 in, 0.015 in, or thicker. In some embodiments, the foil component 204 may be tapered or have varying thickness. In many embodiments, the foil component 204 may be a constant thickness.

The plastic core 206 may be manufactured from many different types of thermoplastic materials. For example, core materials may include thermoplastics such as polyvinyl butyral, polyester (e.g. PETE, PBT, PCT, PETG, PCTG), polyamide, polycarbonate, polysulfone, polyether sulfone, polyphenylene oxide, polyphenylene sulfide, polyphthalamide, polyurethane, acrylonitrile-butadiene-styrene terpolymer, polyacrylonitrile, cellulose ester, polyepoxide, ionomer, polyaryletherketone, liquid crystal polymer, other monomers or polymers, or blends of any of these. Special adhesive resins may be added to the principal thermoplastic.

In some embodiments, thermoset resins may be used as core materials, such as epoxide, phenolic, melamine and polyurethanes. The term "plastic core" as used in the specification and claims is hereby defined to include thermoset resins.

The plastic core 206 may have reinforcements such as glass or graphite fiber. In some embodiments, foaming techniques or glass beads may be used to reduce the weight of the plastic core 206.

In many cross sections, the blade of embodiment 200 may be a constant thickness, with the outer sides of the foil component 204 have approximately parallel sides. In other embodiments, the sides may be concave or convex or have various shapes when viewed on the cross-section.

In some embodiments, the cross sections may not be rectangular as illustration. Such embodiments may include diamond-shaped cross sections, cross sections with concave or convex curves, or other shapes.

The blade of embodiment 200 may have a structural stiffness comparable to a conventional, all-steel blade. The plastic core 206 may take any vertical compression load from a skater, and bending loads may be carried by the foil component 204. Having the foil component 204 on or near the exterior of the blade may allow tension or compression loads due to bending to be carried by the foil component 204. The foil component 204 may be relatively stiff and have a high yield point, and may carry much of the stress due to bending.

Figure 3A:
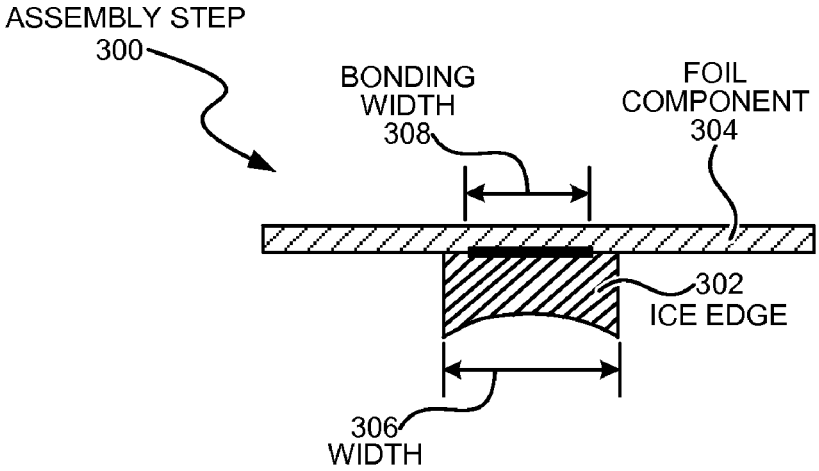
FIG. 3A is a diagram illustration of an embodiment showing a cross-section view of a first assembly step for a composite blade.
Figure 3B:
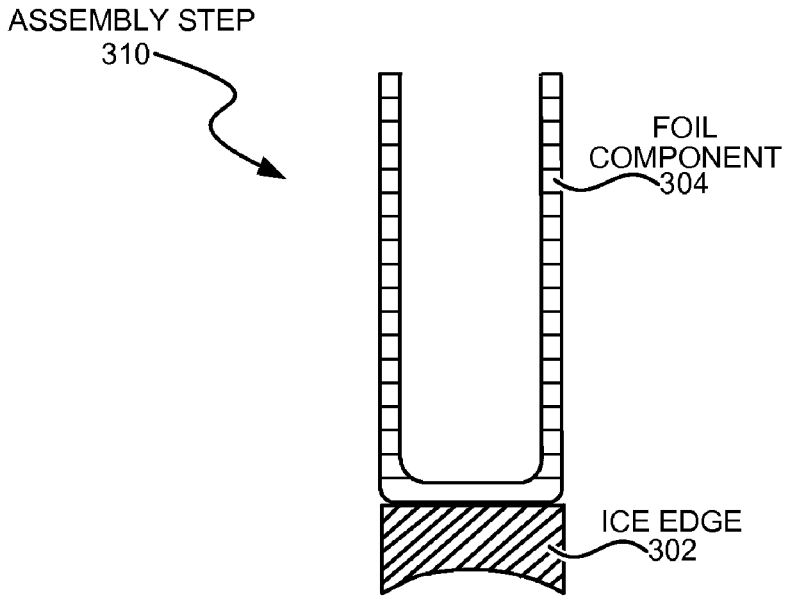
FIG. 3B is a diagram illustration of an embodiment showing a cross-section view of a second assembly step for a composite blade.
Figure 3C:
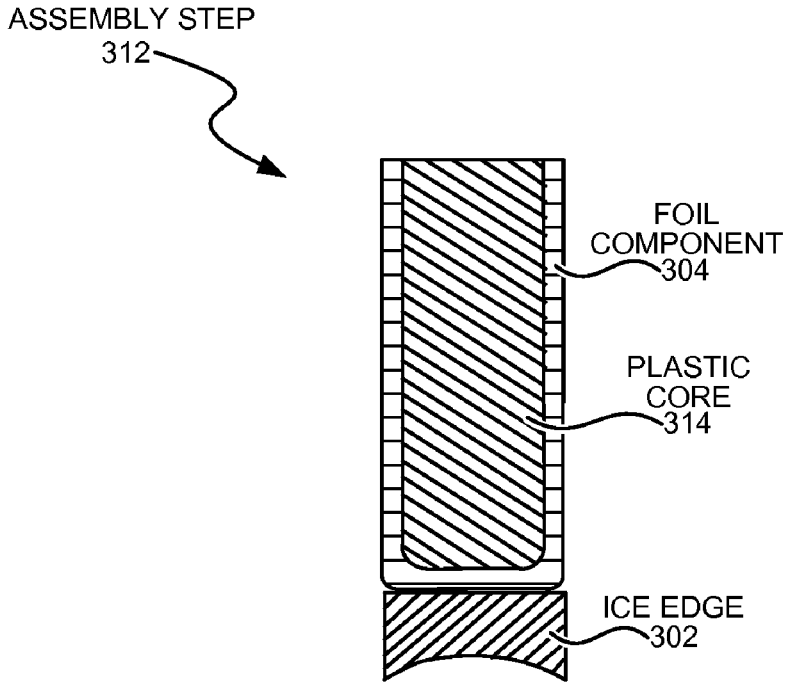
FIG. 3C is a diagram illustration of an embodiment showing a cross-section view of a third assembly step for a composite blade.

FIGS. 3A, 3B, and 3C illustrate three steps of a simplified manufacturing sequence for a composite blade. Each of the FIGS. 3A, 3B, and 3C may show a composite blade in cross-section during a stage of assembly. FIGS. 3A, 3B, and 3C are illustrated as schematic illustrations and are not to scale.

FIG. 3A may illustrate a first assembly step of embodiment 300, where an ice edge 302 may be bonded to a foil component 304. The bonding operation illustrated in embodiment 300 may be a welding or brazing operation, such as electrostatic welding, spot welding, electron beam welding, inductance welding, or other such operation.

The bonding width 308 may be the width of a welded area between the ice edge 302 and the foil component 304. The bonding width 308 may be some width up to the full width 306 of the ice edge 302.

The ice edge 302 and foil components 304 may be manufactured in a strip form and bonded in a continuous process. The ice edge 302 may be a rectangular strip of metal approximately 0.115 in wide with a centerline axis along the length of the strip. The foil component 304 may be a strip of metal foil approximately 0.005 in thick and having a centerline axis along the length of the strip. The foil component 304 may have a constant width during the bonding process, and may be later trimmed or sheared to remove some material from the width either prior to or after forming.

In this specification and claims, the term "wings" is used to describe the portions of the foil component that are not bonded to the ice edge. These portions may be folded, formed, drawn, or otherwise shaped before or after bonding to the ice edge. In some embodiments, the wings may symmetrical, where each side of the foil component is the same width or height as the other. In some cases, the wings may be asymmetrical where one side of the foil component is larger or smaller than the other.

The ice edge 302 and foil component 304 may be bonded such that the centerlines of both components are parallel and centered with respect to each other.

Prior to or following the bonding process illustrated in embodiment 300, the ice edge 302 may or may not be ground to the final curvature. In ice skating applications, the ice edge 302 may be hollow ground with two sharp edges along the sides of the blade. Such sharp edges may not be ground until after assembling the entire blade in some embodiments.

FIG. 3B may illustrate a second step in the manufacturing sequence of a blade. In FIG. 3B, the ice edge 302 and foil component 304 are illustrated, and the foil component 304 has been folded to a parallel configuration.

The assembly process of the blade may involve forming the foil component 304 after bonding to the ice edge 302. In some embodiments, the forming process may be a two stage process. In a two stage process, the foil component 304 may be folded to a parallel or nearly parallel state, and then the foil component 304 and ice edge 302 assembly may be formed to curve the ice edge 302 into the final shape of the blade. The second forming process may be a stretch forming process where the foil component 304 and ice edge 302 assembly are pulled in tension and formed over a mandrel to create the bottom curved shape. Other forming processes may also be used.

In a single stage forming process, the embodiment illustrated in FIG. 3A may be formed over a mandrel to form both the curved bottom shape of the blade as well as forming the sides of the foil component 304 at the same time. Such a process may or may not include applying tension along the axis of the ice edge 302 during forming. Other forming processes may also be used.

FIG. 3C may illustrate a third step in the manufacturing sequence of a blade. In FIG. 3C, the ice edge 302 and foil component 304 are illustrated along with a plastic core 314.

The plastic core 314 may be added to the assembly illustrated in FIG. 3B by several different manufacturing methods. In one method, the assembly of FIG. 3B may be inserted into an injection mold and the plastic core 314 may be formed in place into the blade.

In a second method, the plastic core 314 may be separately manufactured and assembled to the assembly illustrated in FIG. 3B.

Figure 4:
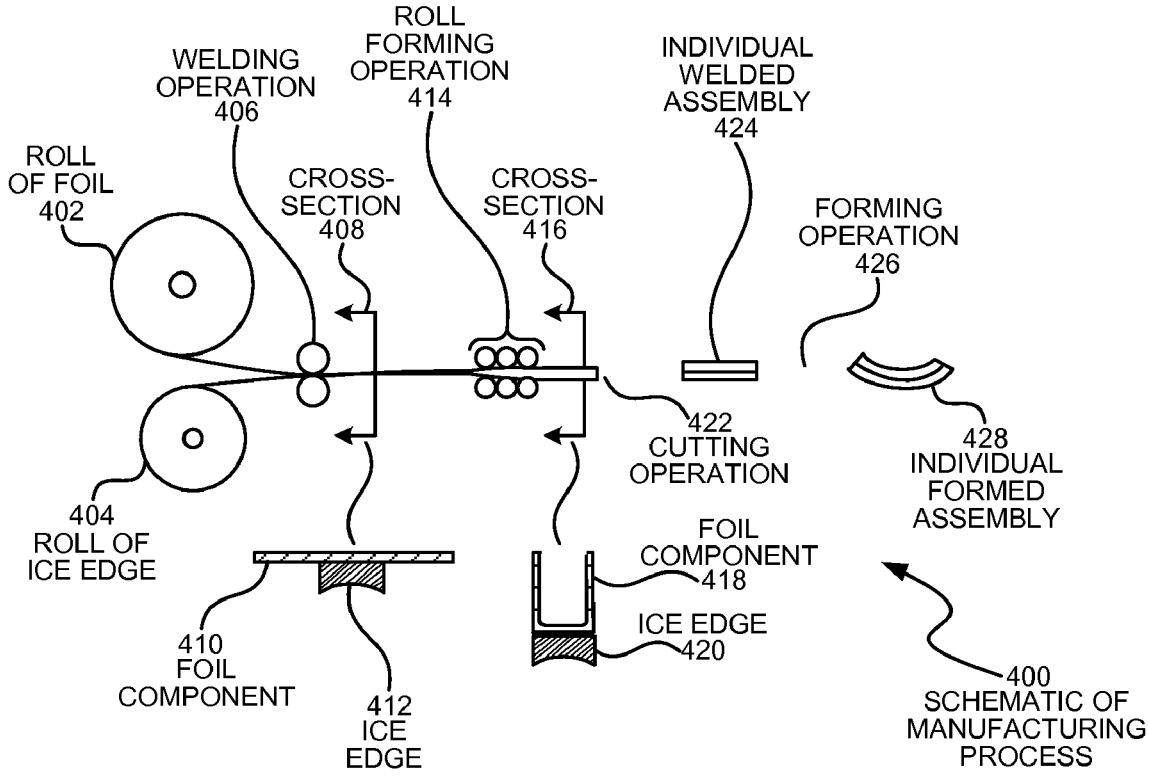
FIG. 4 is a diagram illustration of an embodiment showing a schematic illustration of a manufacturing process.

FIG. 4 is a diagram illustration of an embodiment 400 showing a manufacturing process that may be used to create a composite blade. Embodiment 400 is a schematic illustration and is not to scale.

Embodiment 400 may illustrate one manufacturing process that may be used to create blades in high volumes. Embodiment 400 is used to illustrate one method, but many variations to the method may also be used.

Embodiment 400 illustrates a method for manufacturing an intermediate assembly using a two-step forming process. The intermediate assembly may consist of an ice edge and foil component that are bonded together and formed, ready for injection molding of a plastic core or assembly to a preformed plastic core.

A roll of foil 402 and a roll of ice edge 404 may be unwound and fed into a continuous welding operation 406. The welding operation 406 may produce a cross section 408, that has an ice edge 412 bonded to a foil component 410.

The roll of foil 402 may be a continuous length of flat foil having a rectangular prismatic cross section. The roll of foil 402 may be unwound, straightened, and welded to the ice edge.

The roll of ice edge 404 may be a continuous length of a metal with a rectangular prismatic cross section. In some embodiments, the roll of ice edge 404 may have a concave shape formed into the rectangular cross section as illustrated by the ice edge 412. The roll of ice edge 404 may be unwound, straightened, and welded to the foil component.

The welding operation 406 may be a continuous welding operation that may use brazing, laser, electron beam, induction welding, or electric welding. In a brazing operation, a filler material may be added to the assembly and heated using gas or other heat source. One example of a brazing operation may be silver solder brazing.

When a brazing operation may be used, the foil component and ice edge may be two different metals. For example, the ice edge may be a stainless steel and the foil component may be a different type of steel, aluminum, brass, or other material.

In an electric welding operation, two wheels may apply mechanical force and electrical current that may pass through the bonding area. One example of such a process may be continuous resistance welding. In some embodiments, the welds may be discontinuous and such welds may be spot welds.

After bonding the foil component 410 to the ice edge 412, a roll forming operation 414 may fold the sides of the foil component 418 into a cross section 416, which may consist of the foil component 418 and the ice edge 420.

The roll forming operation 414 may create a U-shaped foil component 418 in a continuous length. A cutting operation 422 may form individual welded assemblies 424.

The individual welded assemblies 424 may go through a forming operation 426 to create an individual formed assembly 428. The forming process 426 may be a stretch forming process where tension may be applied along the axis of the individual welded assembly and the part may be pulled over a single-sided forming die.

In another forming process, the individual welded assembly 424 may be processed using deep drawing or other forming operation using a die and punch. In some cases, the die and punch may draw the foil component 418 to stretch the foil component 418 in some areas. In some deep drawing processes, a clamp may be used to hold the edges of the foil component prior to forming, so that the foil component and the ice edge may be under tension during the forming process.

In still another forming process, the individual welded assembly 424 may be formed using a roll forming operation that may create the rounded bottom portion of the blade.

In yet another forming process, the individual welded assembly 424 may be formed using a rubber pad forming technique, where a rubber pad, water bladder, or other compliable material may be used to form the assembly over a mandrel or tool.

After the individual formed assembly 428, the plastic core may be added. In some cases, the plastic core may be added and then a trimming or profiling operation may be performed. In some cases, a trimming operation may be performed prior to adding the plastic core.

Figure 5A:
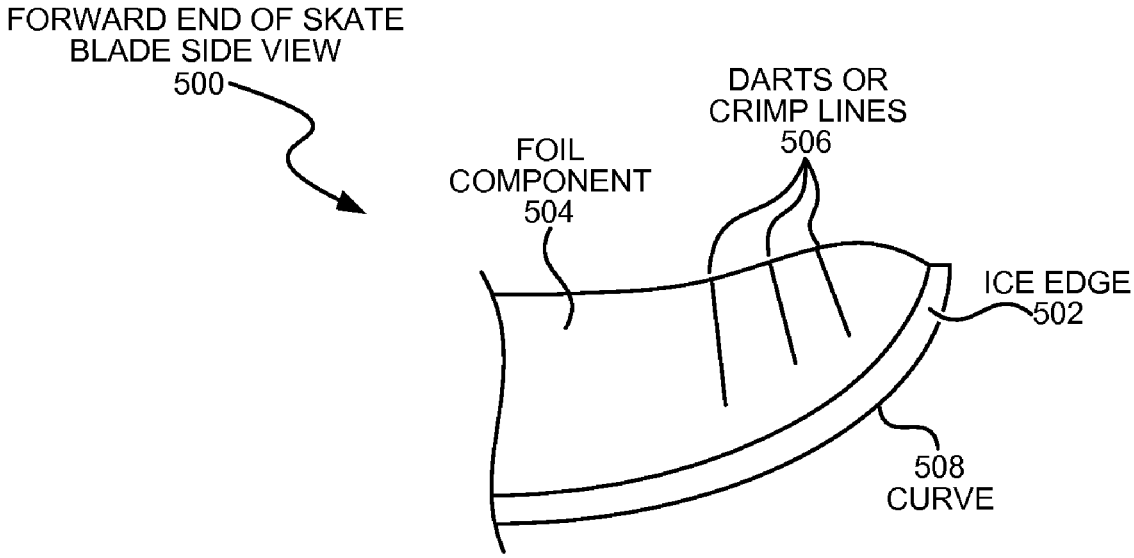
FIG. 5A is a diagram illustration of an embodiment showing a forward end of a skate blade in a side view.

FIG. 5A illustrates an embodiment 500 showing a side view of a forward end of a skate blade. The forward end may also be referred to as the toe end. FIG. 5A is a schematic illustration and is not to scale.

Embodiment 500 illustrates a portion of a blade where the forming operation that creates the curved bottom portion of the blade may create excess material in the foil component.

An ice edge 502 and foil component 504 may be illustrated in the side view. During the forming operation that may create the curve 508, the foil component 504 may bunch up and create crimp lines 506. The crimp lines 506 may represent areas where the foil component 504 has folded over onto itself. In some embodiments, the folds may add strength and stiffness to the toe or heel area.

In some forming processes, such as deep drawing or stretch forming, the crimp lines may be minimized by stretching the foil component 504 during the forming process. In other forming processes, especially where a punch and die may be used, the tooling may flatten the crimp lines 506. Such tooling may be designed to cause some drawing of the foil component during the forming process.

Figure 5B:
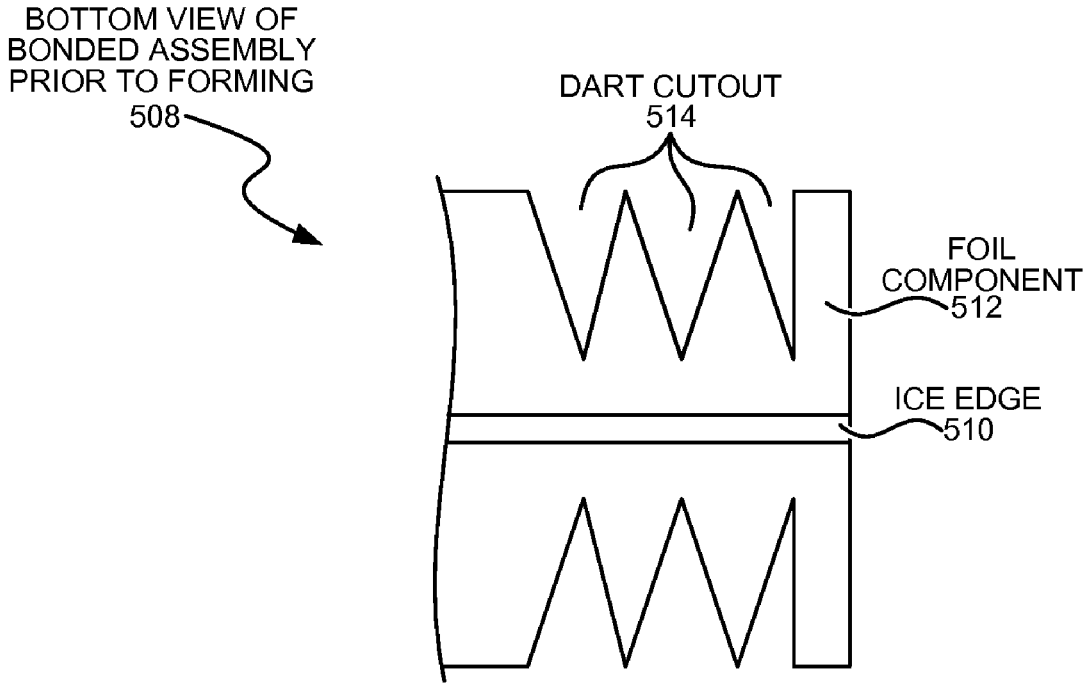
FIG. 5B is a diagram illustration of an embodiment showing a bottom view of a bonded assembly prior to forming.

FIG. 5B illustrates an embodiment 508 showing a bottom view of a bonded assembly showing an ice edge 510 bonded to a foil component 512 prior to forming the foil component 512. FIG. 5B is a schematic diagram and is not to scale.

Embodiment 508 illustrates a foil component 512 that may have been stamped to create a set of dart cutouts 514. The dart cutouts 514 may remove excess material near the forward end of a blade where a sharp radius may be formed, and may be configured to minimize or eliminate any crimping, folding, or distortion in the foil component 512 during the forming process.

Figure 6A:
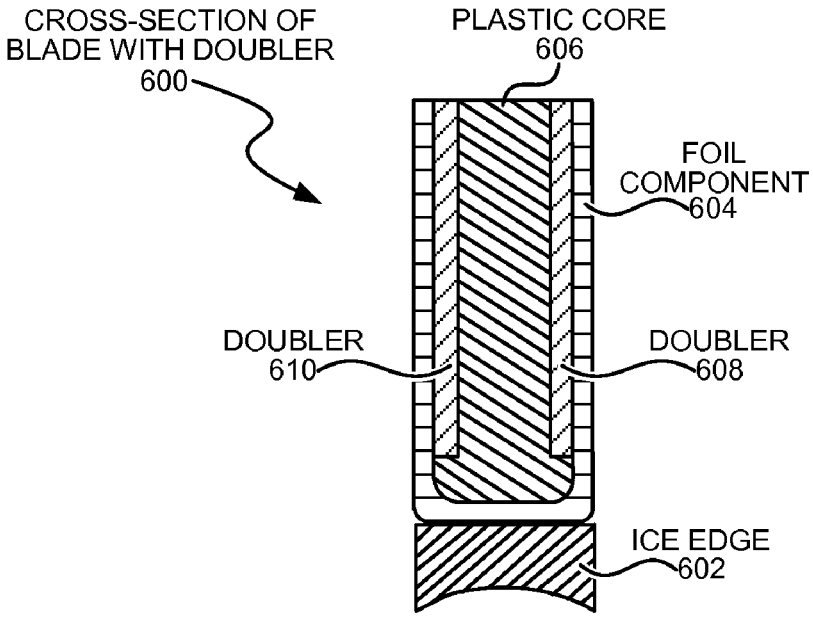
FIG. 6A is a diagram illustration of an embodiment showing a cross-section view of a composite blade with internal doublers.

FIG. 6A illustrates an embodiment 600 showing a cross-section of a blade with internal doublers. FIG. 6A is a schematic illustration and is not to scale.

Embodiment 600 illustrates an ice edge 602, a foil component 604, and a plastic core 606. Between the plastic core 606 and the foil component 604 are two doublers 608 and 610. The doublers 608 and 610 may provide additional stiffness in some embodiments.

The doublers 608 and 610 may be any thickness and any shape. In some embodiments, the doublers 608 and 610 may be the same thickness as the foil component 604, although in other embodiments, the doubler thickness may be greater or less than the thickness of the foil component.

The doublers 608 and 610 may be either metal or nonmetallic. In a metal embodiment, the doublers 608 and 610 may be bonded to the foil component 604 prior to adding the plastic core 606. For example, the doublers 608 and 610 may be spot welded, brazed, or otherwise bonded to the foil component 604. In some embodiments, the doublers 608 and 610 may be bonded using adhesive, such as pressure sensitive adhesive, epoxy adhesive, cured adhesive, or other types of adhesive.

In some embodiments, the doublers 608 and 610 may be mechanically coupled or engaged with the foil component 604. In one such embodiment, a stamping operation may crimp or join the doublers 608 and 610 to the foil component 604.

In some embodiments, the doublers 608 and 610 may be perforated or have cutouts or holes that may allow the plastic core to bond directly to the foil component 604 in some areas.

When the doublers 608 and 610 are nonmetallic, the doublers 608 and 610 may be bonded to the foil component 604 or the plastic core 606 prior to assembly. In some embodiments, the assembly of the foil component 604, plastic core 606, and doublers 608 and 610 may be bonded at the same time.

Figure 6B:
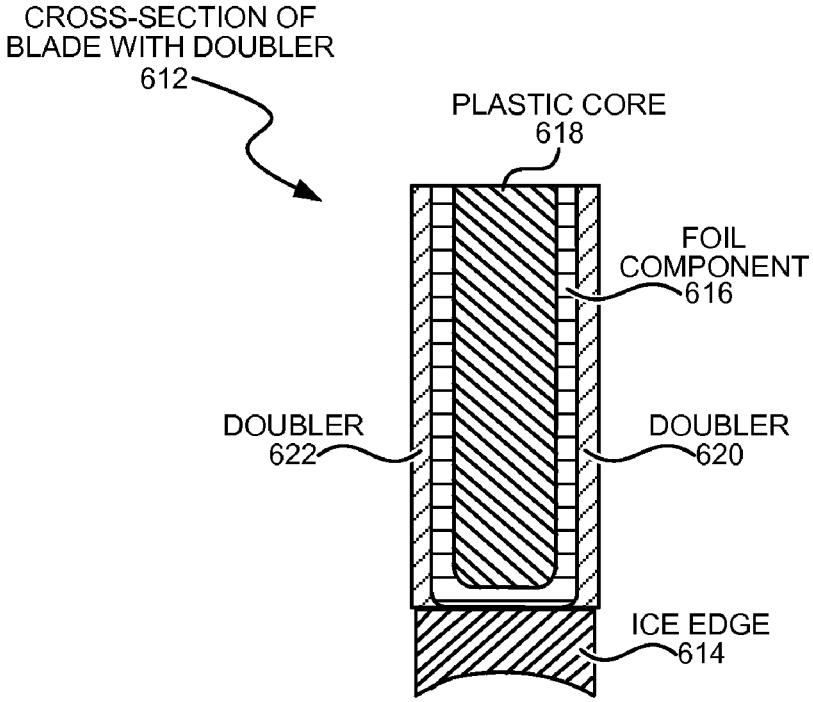
FIG. 6B is a diagram illustration of an embodiment showing a cross-section view of a composite blade with external doublers.

FIG. 6B illustrates an embodiment 612 showing a cross-section of a blade with external doublers. FIG. 6B is a schematic illustration and is not to scale.

Embodiment 612 shows an ice edge 614, a foil component 616, and plastic core 618. Doublers 620 and 622 may be applied to the external side of the foil component 616.

The external doublers 620 and 622 may be structural components such as metallic components that are bonded to the foil component 616. In other embodiments, the external doublers 620 and 622 may be aesthetic components that may be used to cover the foil component 616 to provide advertisement, logos, colored inserts, or other aesthetic features.

When the external doublers 620 and 622 are structural components, the external doublers 620 and 622 may be sheet metal forms that may be stamped or cut to a predefined shape. Such forms may be bonded to the foil component 616 prior to bonding to the plastic core 618, and may be bonded using welding, brazing, mechanical attachment, or other mechanism.

When the external doublers 620 and 622 are nonstructural components, the external doublers 620 and 622 may be labels or other items that may be attached using pressure sensitive adhesive, epoxy, or other attachment mechanism.

Figure 7:
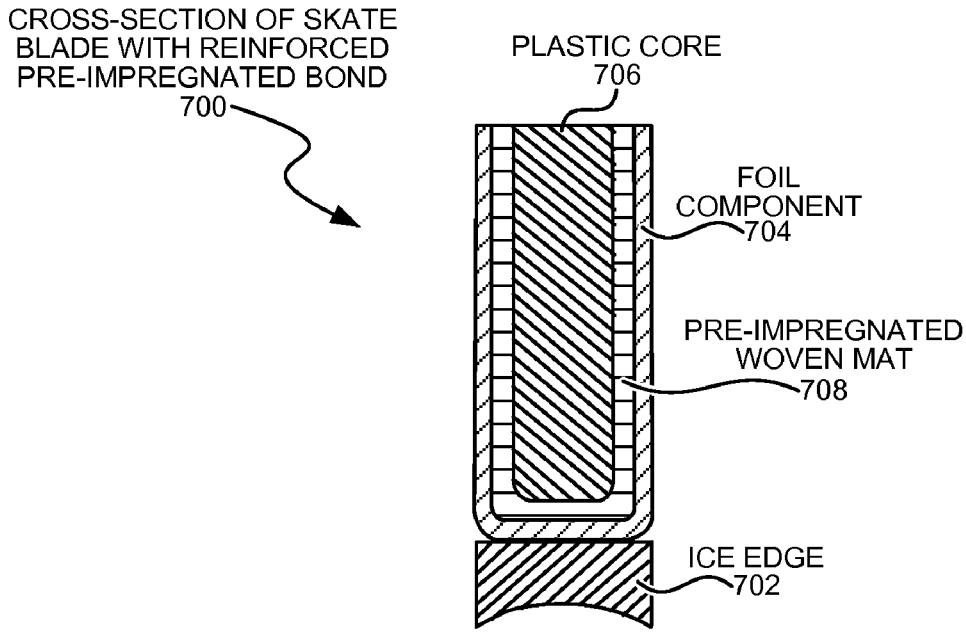
FIG. 7 is a diagram illustration of an embodiment showing a cross-section view of a composite blade with a reinforced pre-impregnated bond.

FIG. 7 illustrates an embodiment 700 showing a cross-section of a blade with reinforced pre-impregnated bond. FIG. 7 is a schematic illustration and is not to scale.

Embodiment 700 may have an ice edge 702, a foil component 704, and a plastic core 706. Between the foil component 704 and the plastic core 706, a pre-impregnated woven fabric or mat 708 may be used to bond the plastic core 706 to the foil component 706.

The pre-impregnated woven mat 708 may be a fiberglass or graphite woven, randomly oriented, or unidirectional material that may be pre-impregnated with epoxy or other resin. The woven mat 708 may be placed over the plastic core 706 or in the foil component 704 prior to assembling the items together. Once assembled, the assembly may be cured in a press, an oven or an autoclave. In some embodiments, a vacuum may be applied to the assembly during such a cure.

In some embodiments, tooling may provide two parallel surfaces on the exterior of the foil component 704 so that the cured assembly may have a consistent thickness and parallel sides.

In some embodiments, the pre-impregnated woven mat 708 may produce a stiff, structural element in the composite structure of the blade.

Figure 8:
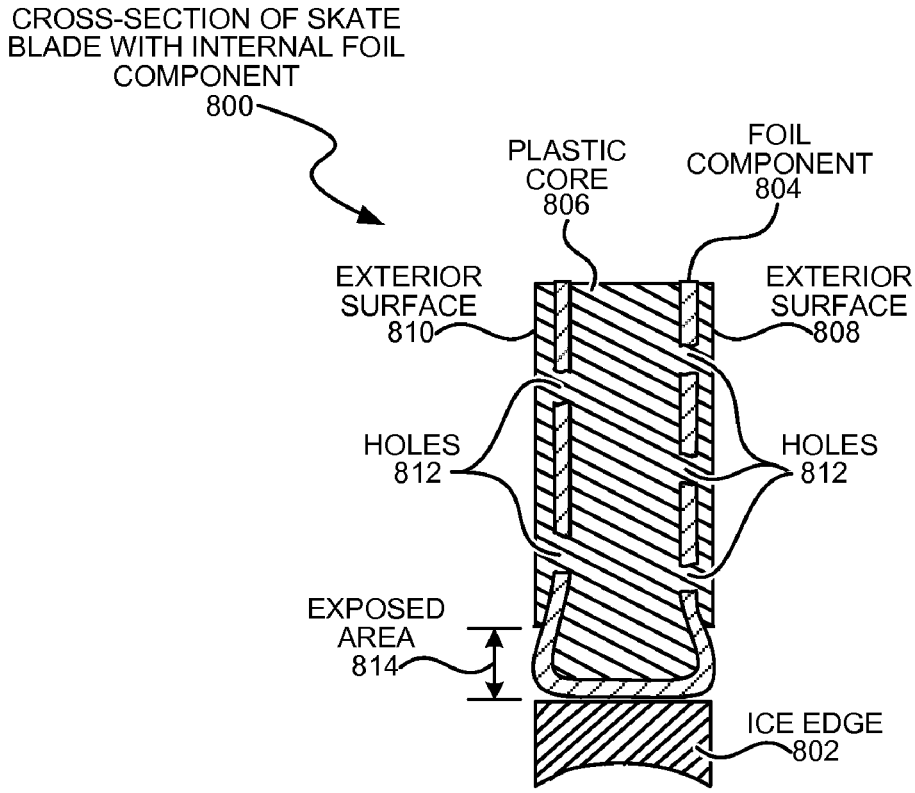
FIG. 8 is a diagram illustration of an embodiment showing a cross-section view of a composite blade with an internal foil component.

FIG. 8 illustrates an embodiment 800 showing a cross-section of a blade with an internal foil component. FIG. 8 is a schematic illustration and is not to scale.

Embodiment 800 may have an ice edge 802, a foil component 804, and a plastic core 806.

The plastic core 806 may be injection molded into a preformed assembly of the ice edge 802 and foil component 804, and the foil component 804 may have several holes 812 that may allow the plastic material to flow to the exterior surfaces 808 and 810. In some embodiments, the configuration may allow an exposed area 814 of the foil component 804. Other embodiments may not expose the foil component 804.

Embodiment 800 may expose plastic material to the exterior surfaces of the blade. In some embodiments, the plastic material may be colored or tinted to provide a colorful aesthetic appeal. Some embodiments may include designs, logos, wording, or other features molded into the blade. Such features may be recessed into the blade, for example.

Figure 9A:
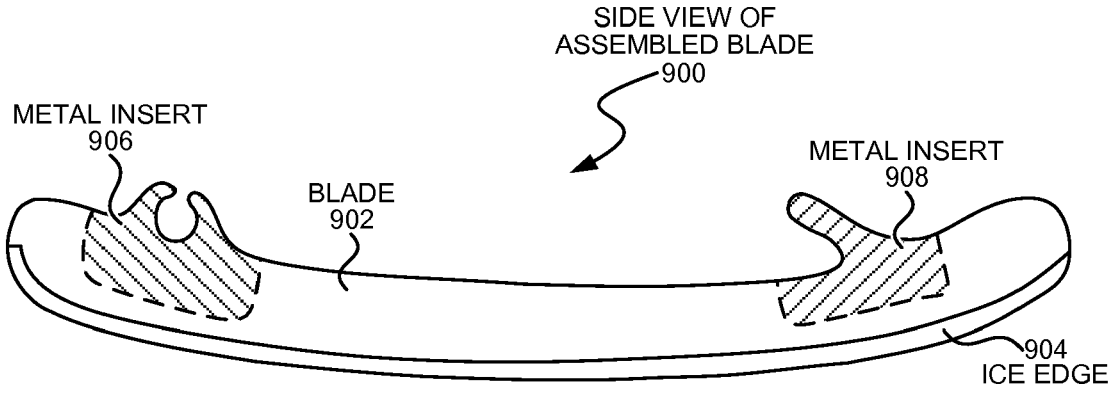
FIG. 9A is a diagram illustration of an embodiment showing a side view of an assembled composite blade with attachment inserts.

FIG. 9A illustrates an embodiment 900 showing a side view of an assembled blade along with metal inserts that may be used in the attachment points of the blade. FIG. 9A is a schematic illustration and is not to scale.

The blade 902 has an ice edge 904 and metal insert 906 in the rear or heel of the blade and metal insert 908 at the front or toe of the blade. The metal inserts 906 and 908 may be added to the assembly during the assembly process and may bond to the plastic core, the foil component, or to both the plastic core and the foil component. In some cases, the metal inserts may extend to contact the foil component at the bonding area between the foil component and the ice edge 904.

The metal inserts 906 and 908 may be useful in embodiments where the plastic core may not have enough strength at the attachment points. Such embodiments may include when the plastic core may be foamed or have fillers that may reduce weight but may also reduce strength.

In some cases, the metal inserts 906 and 908 may be a different material from the ice edge 904. For example, the metal inserts 906 and 908 may be stamped or machined steel, stainless steel, titanium, or other metal.

Figure 9B:
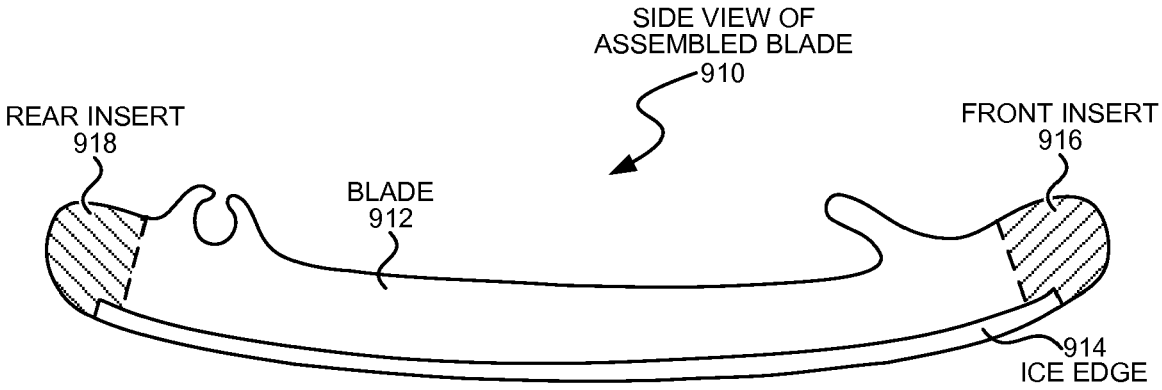
FIG. 9B is a diagram illustration of an embodiment showing a side view of an assembled composite blade with front and rear inserts.

FIG. 9B illustrates a second embodiment 910 showing a side view of an assembled blade with inserts. The blade 912 is shown with an ice edge 914 and a front insert 916 and rear insert 918. FIG. 9B is a schematic illustration and is not to scale.

The inserts 916 and 918 may be added to the blade in the areas that may have tighter radii and may be hard to form. The inserts 916 and 918 may be a similar or same material as the ice edge 914 and may be sharpened when the ice edge 914 is sharpened.

In some embodiments, several inserts may be used. For example, an embodiment may have attachment inserts such as inserts 906 and 908 as well as front insert 916 and rear insert 918.

In some embodiments, a single insert may combine the features of two inserts. For example, a rear insert 918 may include the fastening features of insert 906. In another example, a front insert 916 may include the attachment features of insert 908.

In some embodiments, the front insert 916 may be serrated to form a figure skating blade.

Figure 10A:
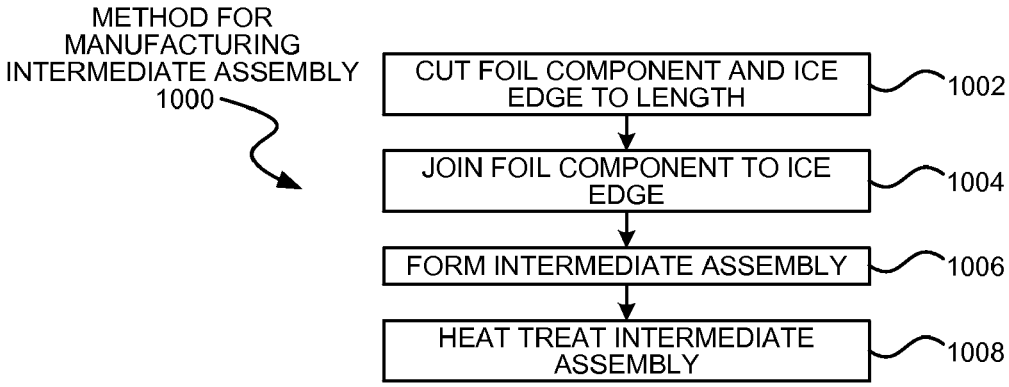
FIG. 10A is a flowchart illustration of a first embodiment showing a method for manufacturing an intermediate assembly.
Figure 10B:
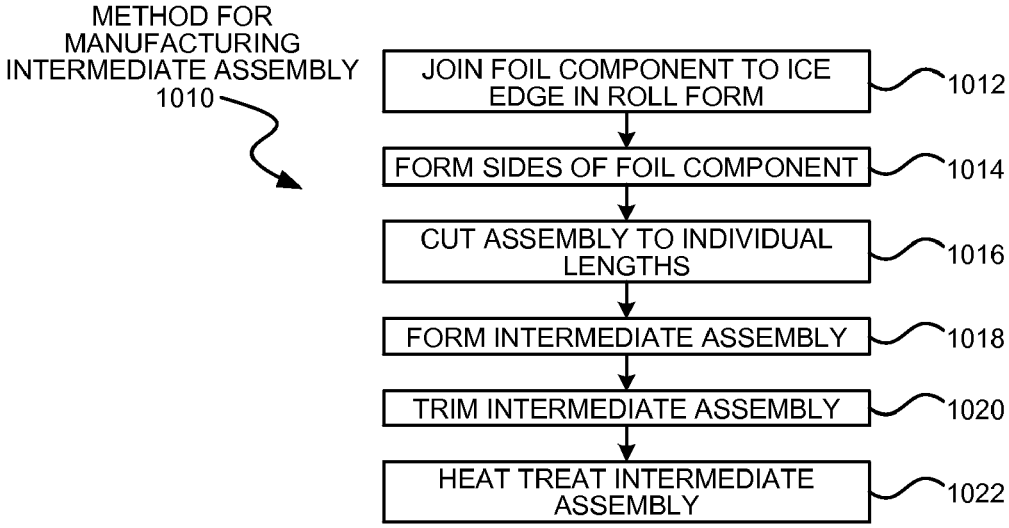
FIG. 10B is a flowchart illustration of a second embodiment showing a method for manufacturing an intermediate assembly.
Figure 10C:
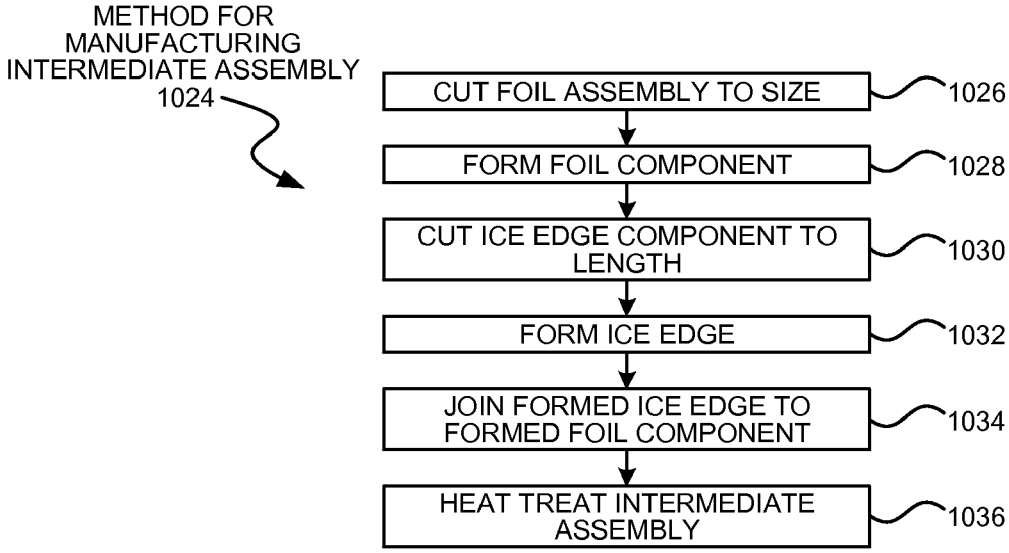
FIG. 10C is a flowchart illustration of a third embodiment showing a method for manufacturing an intermediate assembly.

FIGS. 10A, 10B, and 10C are flowchart illustrations of embodiments 1000, 1010, and 1024, respectively, that illustrate three different methods for manufacturing an intermediate assembly. An intermediate assembly may contain the metal components of a composite blade.

Other embodiments may use different sequencing, additional or fewer steps, and different nomenclature or terminology to accomplish similar functions. In some embodiments, various operations or set of operations may be performed in parallel with other operations, either in a synchronous or asynchronous manner. The steps selected here were chosen to illustrate some principles of operations in a simplified form.

In FIG. 10A, embodiment 1000 illustrates an example assembly method for an intermediate assembly for a composite blade.

In block 1002, the foil component and ice edge component may be cut to length. In some embodiments, the assembly process may be performed on individual pieces of the foil component and ice edge components. In such embodiments, the cutting process in block 1002 may cut the ice edge and foil components to a rough size which may or may not contain excess material that may be removed later.

In some embodiments, the foil components may be cut into some shape other than a rectangle. For example, darts or other material may be removed from the foil components. In another example, the foil components may be cut out to fit a profile that may be the final profile of the blade or may have additional material that may be trimmed later.

The foil component and ice edge may be bonded in block 1006. The ice edge and foil components may be bonded in the flat state in block 1006. The bonding may be welding, brazing, or other metal joining process.

In block 1008, the joined components may be formed using a forming process. The forming process may use a punch and die, a forming block and rubber bladders, or any other forming process. In some embodiments, a stretch forming process may be used. Other embodiments may use a draw forming process.

After forming, the intermediate assembly may be heat treated in block 1008. The heat treatment of block 1008 may allow the forming and bonding operations to occur when the metal components may be in a softer state than after heat treatment. The heat treatment may increase the durability of the ice edge after sharpening.

In FIG. 10B, embodiment 1010 illustrates a second example assembly method for an intermediate assembly for a composite blade.

In block 1020, the foil component may be joined to an ice edge in roll form. Such a joining process may be as described in embodiment 400. While still in roll form, the sides of the foil component may be formed in block 1014. The ice edge may be ground for side smoothness and for sharpness prior to being joined with the foil component.

In some cases, the roll forming process may form the foil component sides to the final position, which may be parallel. In other cases, the roll forming process may form the foil component to an intermediate position.

The continuous assembly may be cut into individual lengths in block 1016. In many embodiments, the cutting operation of block 1016 may slice the assembled strip materials into rectangular sections. In some embodiments, a stamping operation may be used to cut a profile into the foil component as part of the cutting operation.

The individual assemblies may be formed in block 1018 using any of a variety of forming operations. For example, the forming process may use a punch and die, a forming block and rubber bladders, or any other forming process. In some embodiments, a stretch forming process may be used. Other embodiments may use a draw forming process.

In some embodiments, a trimming operation may be performed in block 1020 after the forming operation of block 1018. The trimming operation may remove excess material that may be used, for example, to grip portions of the assembly during a forming operation.

After trimming in block 1020, the intermediate assembly may be heat treated in block 1022.

In FIG. 10C, embodiment 1024 illustrates a third example assembly method for an intermediate assembly for a composite blade. Embodiment 1024 may be an example of a process where the foil component and ice edge are formed separately, then joined together after forming.

A foil component may be cut to size in block 1026 and formed in block 1028. The foil component may be cut to a rectangular shape in some cases, while in other cases, the foil component may be cut to another shape. Examples of other shapes may include darts or other features that may bring the formed shape close to the final shape of the composite blade.

In some cases, the foil component may be formed using deep drawing techniques to create a formed shape.

The ice edge may be cut to length in block 1030 and formed in block 132.

The formed ice edge may be joined to the formed foil component in block 1034 and heat treated in block 1036. In some embodiments, the forming and heat treatment may be performed in the same step. For example, a brazing operation may be performed while performing a heat treatment operation. In other embodiments, the bonding operation may be performed prior to heat treatment.

Figure 11A:
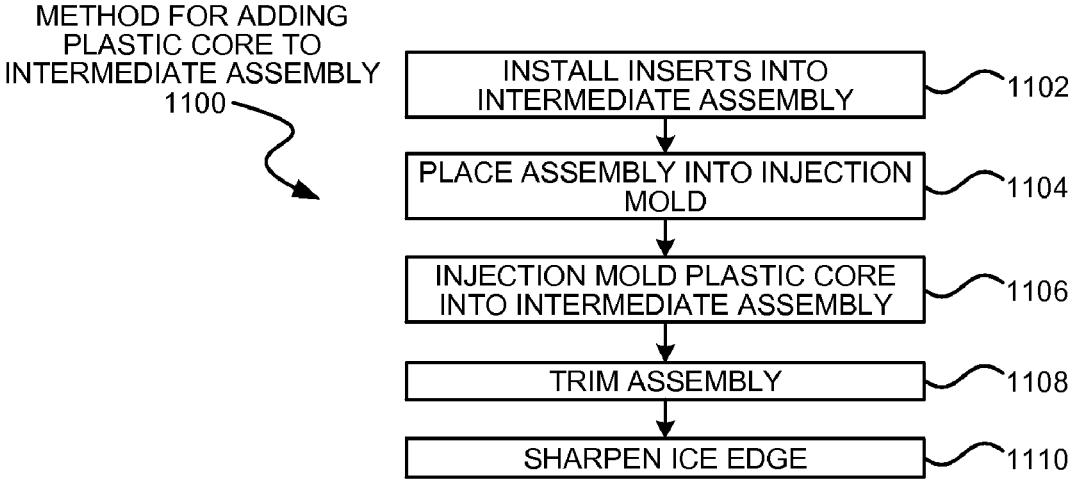
FIG. 11A is a flowchart illustration of a first embodiment showing a method for assembling a plastic core to an intermediate assembly to form a composite blade.
Figure 11B:
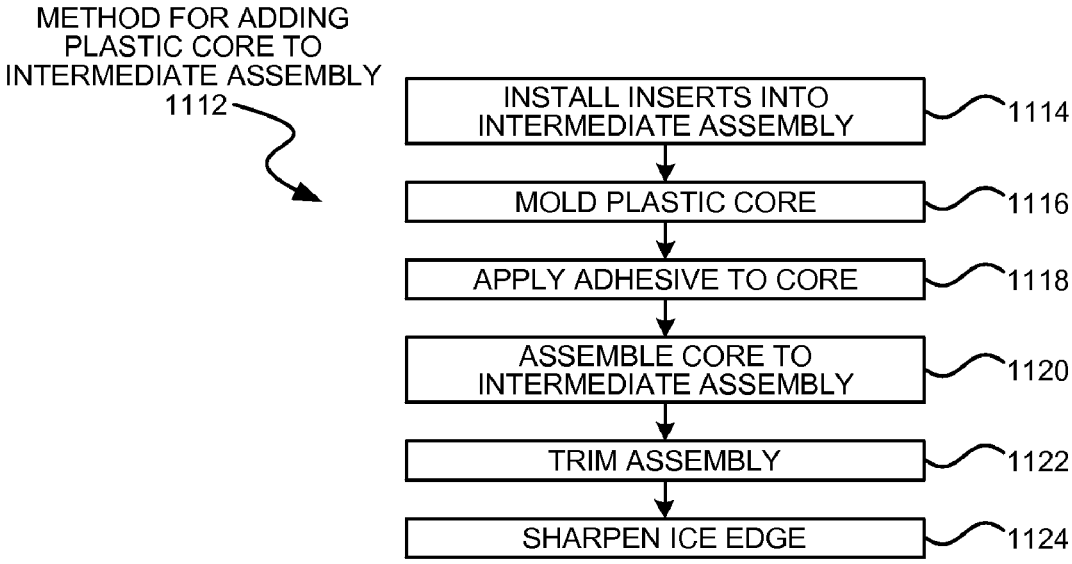
FIG. 11B is a flowchart illustration of a second embodiment showing a method for assembling a plastic core to an intermediate assembly to form a composite blade.

FIGS. 11A and 11B are flowchart illustrations of embodiments 1100 and 1112, respectively, that illustrate two different methods for adding a plastic core to an intermediate assembly. The operations of embodiments 1100 and 1112 may be performed on intermediate assemblies created by any of embodiments 1000, 1010, or 1024, as well as other manufacturing processes.

Other embodiments may use different sequencing, additional or fewer steps, and different nomenclature or terminology to accomplish similar functions. In some embodiments, various operations or set of operations may be performed in parallel with other operations, either in a synchronous or asynchronous manner. The steps selected here were chosen to illustrate some principles of operations in a simplified form.

In FIG. 11A, embodiment 1100 illustrates an example assembly method for adding a plastic core to an intermediate assembly to create a composite blade.

In block 1102, any inserts that may be used in the blade may be installed into the intermediate assembly. Inserts may include internal or external doublers, fastening inserts, heel or toe inserts, or other additional parts.

The assembly may be placed into an injection mold in block 1106 and the plastic core may be formed inside the intermediate assembly in block 1108. In some embodiments, the intermediate assembly may be prepared prior to injection molding by cleaning or coating the surfaces prior to molding.

After injection molding, the assembly may be trimmed in block 1108. In some embodiments, the foil components as well as the injection molded portions of the assembly may be trimmed to a final state in block 1108.

The ice edge may be sharpened or honed in block 1110 to create a finished composite blade ready for use in a skate or other device.

In FIG. 11B, embodiment 1112 illustrates a second example assembly method for adding a plastic core to an intermediate assembly to create a composite blade.

In block 1114, any inserts that may be used in the blade may be installed into the intermediate assembly. Inserts may include internal or external doublers, fastening inserts, heel or toe inserts, or other additional parts.

The plastic core may be molded or manufactured in block 1116. After molding, adhesive may be applied to the core in block 1118 and assembled to the intermediate assembly in block 1120. The adhesive may be cured prior to trimming in block 1122 and sharpening or honing the ice edge in block 1124. After block 1124, the finished composite blade may be ready for use in a skate or other device.

The operation of embodiment 1112 illustrates an assembly process that may be performed after the plastic core is manufactured. In some embodiments, a pre-impregnated woven material may be used as the bonding adhesive and may be applied to the plastic core prior to assembly.

Figure 12A:
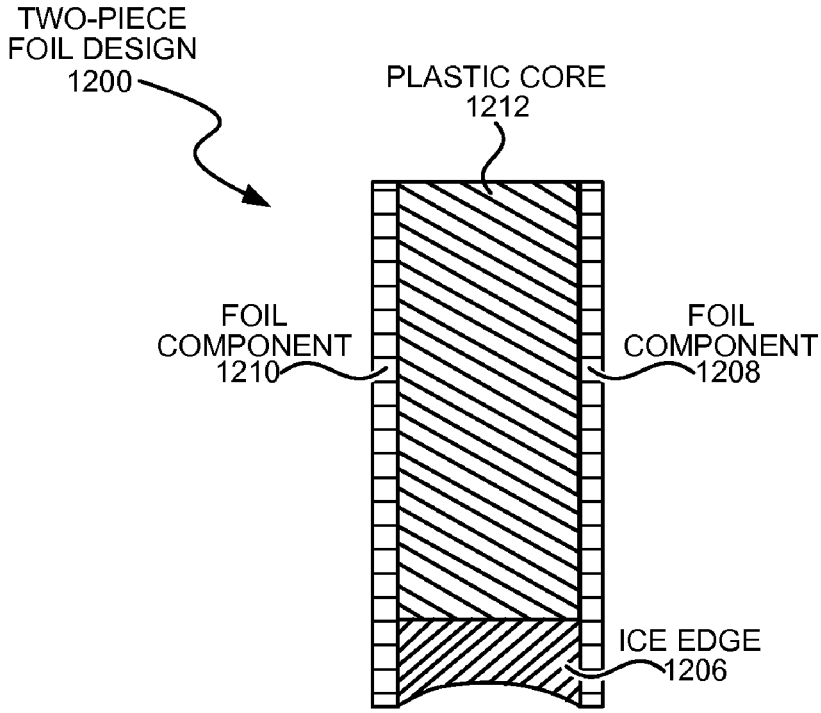
FIG. 12A is a diagram illustration of an embodiment showing a cross-section view of a composite blade with two foil components.
Figure 12B:
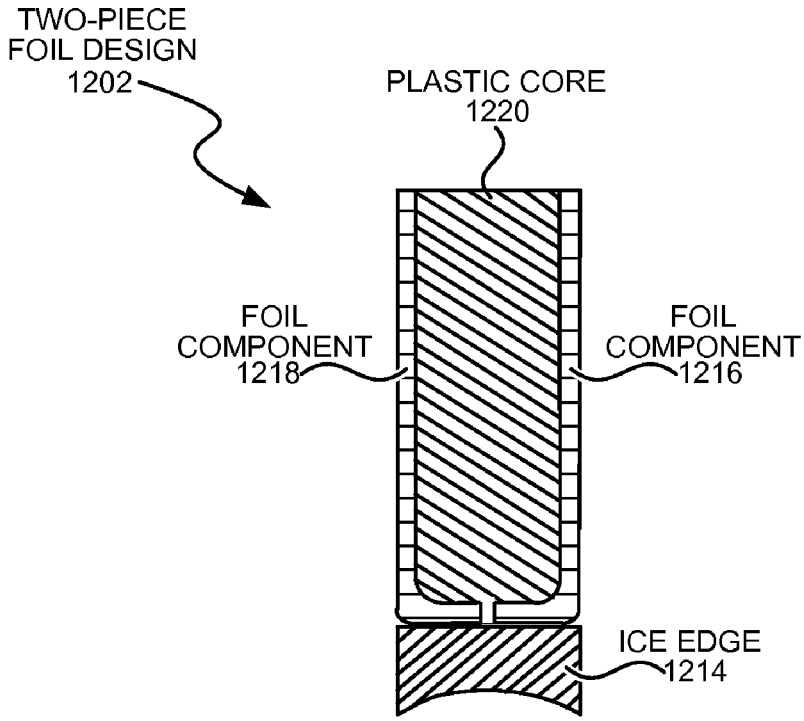
FIG. 12B is a diagram illustration of an embodiment showing a cross-section view of a composite blade with two foil components.
Figure 12C:
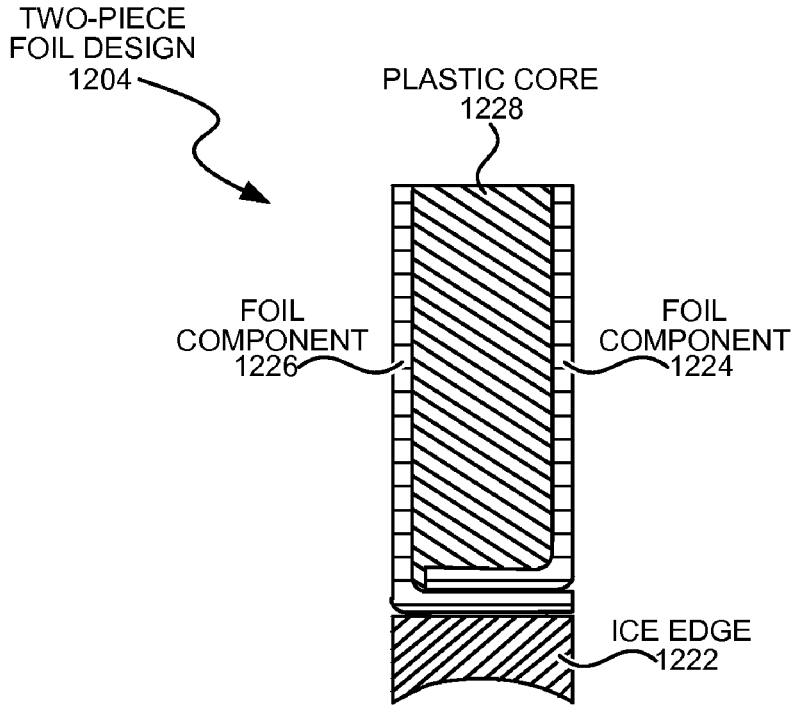
FIG. 12C is a diagram illustration of an embodiment showing a cross-section view of a composite blade with two foil components.

FIGS. 12A, 12B, and 12C illustrate embodiments 1202, 1204, and 1206 showing three different configurations that have two foil components.

In some embodiments, the foil component may be manufactured from two separate pieces. The foil components may be stamped into various configurations and assembled to an ice edge to create an intermediate assembly. Once assembled into an intermediate assembly, the plastic core may be added.

In some cases where two foil components are used, the foil components and ice edge may be formed into their final shape prior to bonding.

In FIG. 12A, an ice edge 1206 may have foil components 1208 and 1210 attached to the sides of the ice edge 1206. The plastic core 1212 may be formed in place or added in a secondary assembly step.

In embodiment 1200, the foil components 1208 and 1210 are illustrated as covering the entire side of the ice edge 1206. Other embodiments may have the foil components connecting to the ice edge for only a portion of the ice edge outer sides. Some such embodiments may have rabbets or other features in the ice edge 1206 to accept the foil components.

In FIG. 12B, an ice edge 1214 may have foil components 1216 and 1218 attached to the upper side of the ice edge 1214. A plastic core 1220 may complete the composite blade.

In embodiment 1202, the foil components 1216 and 1218 may be formed with an 'L' shape and may be bonded to the top portion of the ice edge 1214. In some cases, the foil components 1216 and 1218 may be formed prior to assembly, although some embodiments may join the foil components to the ice edge and then perform a forming operation.

In FIG. 12C, an ice edge 1222 may have foil components 1224 and 1226 attached to the upper side of the ice edge 1222. A plastic core 1228 may complete the composite blade.

In embodiment 1204, the foil components 1224 and 1226 are formed into an 'L' shape like in embodiment 1202, except that the bottom portions of the foil components may overlap.

Figure 13:
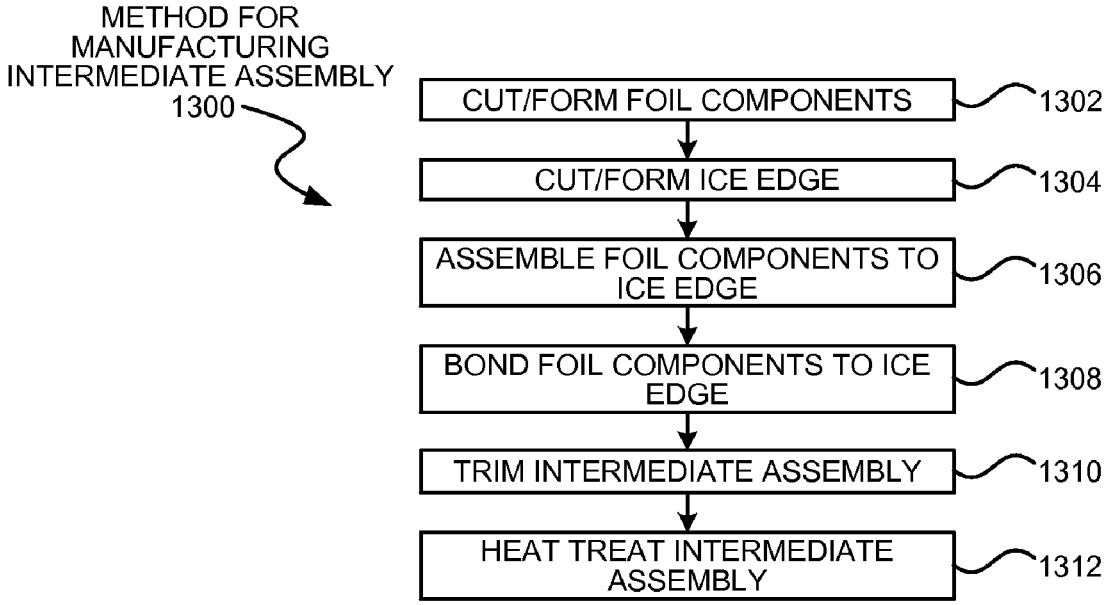
FIG. 13 is a flowchart illustration of an embodiment showing a method for manufacturing an intermediate assembly using two foil components.

FIG. 13 is a flowchart illustration of an embodiment 1300 showing an assembly process for an intermediate assembly comprising two foil components.

In block 1302, the foil components may be cut to shape. In some cases where the foil components are not flat, such as in embodiments 1202 and 1204 illustrated in FIGS. 12B and 12C, respectively, the foil components may be stamped or formed into shape.

The ice edge may be cut and formed in block 1304, and assembled to the foil components in block 1306. The assembly may be bonded in block 1308, and then trimmed in block 1310. After trimming, the intermediate assembly may be heat treated in block 1312.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A composite ice blade comprising:

a steel ice edge having an ice contact surface and a bonding surface opposite said ice contacting surface, said steel ice edge further having a primary axis;

a foil component having a centerline, an outer bonding surface bonded to said steel ice edge such that said centerline is aligned with said primary axis, said foil component further having two wings disposed outward from said centerline and an inner bonding surface opposite said outer bonding surface; and a plastic center core having a bottom surface bonded to said foil component opposite said outer bonding surface and two sides, each of said two sides being bonded to a respective one of said two wings.

2. The composite ice blade of claim 1, said foil component being at least partially perforated along said two sides.

3. The composite ice blade of claim 1 further comprising:

at least one attachment insert having a fastener receiver, said attachment insert being steel.

4. The composite ice blade of claim 1 further comprising:

a reinforced fabric comprising adhesive disposed between said plastic center core and said foil component.

5. The composite ice blade of claim 1, said two sides being substantially parallel.

* * * * *